US006349681B1

(12) United States Patent
Li

(10) Patent No.: US 6,349,681 B1
(45) Date of Patent: Feb. 26, 2002

(54) CYLINDER BLOCK FOR INTERNAL COMBUSTION ENGINE

(75) Inventor: Chin-Hsiu Li, Bloomfield Hills, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 09/575,254

(22) Filed: May 22, 2000

(51) Int. Cl.[7] ..... F02B 75/18

(52) U.S. Cl. ..... 123/41.74; 123/41.79; 165/104.26

(58) Field of Search ..... 123/41.72, 41.74, 123/41.79; 165/104.26

(56) References Cited

U.S. PATENT DOCUMENTS 3,884,293 A * 5/1975 Pessolano et al. ..... 165/51
4,013,047 A * 3/1977 Harned ..... 123/41.12
4,194,559 A 3/1980 Eastman ..... 165/105
4,253,431 A * 3/1981 Mettig et al. ..... 123/41.72
5,474,040 A 12/1995 Murakami et al. ..... 123/195 R

* cited by examiner

*Primary Examiner*—Tony M. Argenbright
*Assistant Examiner*—Katrina B. Harris
(74) *Attorney, Agent, or Firm*—George A. Grove; Jeffrey A. Sedlar

(57) ABSTRACT

A cylinder block, often a siamese cylinder block, for an internal combustion engine having a heat pipe located in each of the common walls between adjacent cylinders where at least one of the ends of each heat pipe extends into the cylinder block coolant passage such that heat emanating from each cylinder flows into an adjacent portion of one or more heat pipes and flows through the pipes by continuous evaporation and condensation of the pipe's working fluid into the engine coolant.

6 Claims, 2 Drawing Sheets

CYLINDER BLOCK FOR INTERNAL COMBUSTION ENGINE

TECHNICAL FIELD

This invention pertains to a cylinder block for an internal combustion engine. More specifically, this invention pertains to an improved cooling arrangement for an engine cylinder block.

BACKGROUND OF THE INVENTION

Reciprocating internal combustion engines typically have a cast cylinder and crankcase block formed with a plurality of parallel cylinder bores with their longitudinal axes coplanar. In other words, the block contains a line of cylinders, and in a V-block there are two banks of cylinders in a line. The cylinder bores are substantially identical to accommodate identical pistons each connected through a connecting rod to a crankshaft. The lower end of each bore accommodates a piston and its connecting rod, and the upper end provides the working and combustion volume of the cylinder. The upper surface of the block, sometimes called its top deck, is machined flat for sealing engagement with the cylinder head block (or head blocks in the case of a V-shaped engine).

The cylinder block is a body of intricate shape and formed with a cooling jacket defining passages for engine coolant (water, ethylene or propylene glycol and additives) to flow around the upper portion of the cylinder bores to remove extraneous combustion heat from them. In some engines, the cooling passages encircle the combustion region of each cylinder so that heat is removed from the full circumference of each cylinder. However, in an effort to reduce the size and weight of engines, some engine blocks have been designed without coolant flow passages between the cylinders. Engine blocks of this design are called siamese blocks because adjoining cylinders are formed in the block with a common wall and without a coolant flow passage separating them.

Engine designers often resort to siamese cylinder block construction to save engine compartment space when iron cylinder liners are to be used in a cast aluminum block. When the cylinder bore is enlarged to receive an iron or steel liner, the resulting aluminum web between adjacent cylinders is not thick enough for reliable coring and casting of a coolant passage.

Designers have worked to enhance the flow of coolant in the remaining coolant passage area to compensate for the lost cooling surface area between the cylinders. But siamese block engines often experience a hot zone at the top of each cylinder in the area between them where there is no coolant flow. Such hot zones can shorten the life of piston rings due to local micro-welding in the top piston ring groove and tearing of ring material. Thus, there remains a need for a way to better cool the intra-cylinder webs in the deck region of engine cylinder blocks and especially in siamese cylinder blocks.

SUMMARY OF THE INVENTION

This invention is applicable to engine cylinder blocks generally and is especially applicable to siamese cylinder blocks. In accordance with the invention, an engine cylinder block is provided with one or more small, highly efficient heat exchangers located in cylinder wall portions of the block, preferably at or near its top deck surface, with at least one end of the heat exchanger extending into a coolant passage in the block. The heat exchangers are heat pipes that in the case of a siamese cylinder block, for example, preferably extend across the width of the common cylinder walls from the coolant passage on one side of the cylinder line to the coolant passage on the other side of the line.

As is known, heat pipes comprise evacuated, closed end pipes or casings of suitable diameter and length that have an internal longitudinal wick and are back-filled with a suitable quantity of a liquid that undergoes repeated vaporization and condensation to transport heat. The pipe and wick structure are usually made of a high thermal conductivity metal such as copper. But beyond the thermal conductivity of their structural elements, heat pipes accommodate a large heat flux for their size because they utilize the repeated, cyclic vaporization and condensation of a substance like water with high latent heat of such phase changes in removing heat from the top deck region of the block between the cylinders and transporting it to the coolant in the adjacent passages. The porous wick permits the condensed water at the coolant end of the pipe to flow under capillary forces back to the hot portion of the pipe near the cylinder bore. Obviously, one or more pipes may be used in the hot region of the block, and the heat flow from a pipe may be bi-directional or unidirectional.

One or more heat pipes may, for example, be embedded in the deck region of the block when it is cast. Each heat pipe would be placed like a core in the mold or pattern when the block is die or gravity cast or formed by lost foam casting. Aluminum casting alloy envelops the copper tube heat pipe(s) in a suitable bond for heat transfer. In a preferred embodiment, a relatively long heat pipe is located in each common wall between adjacent cylinders so that the ends of the pipes extend into the coolant passages. Heat flows from the two cylinders into their intra-wall and the central region of the pipe. The heat flux evaporates the working liquid (e.g., water) in each pipe and the vapor flows bi-directionally to the ends of the pipe where it is condensed, giving up its latent heat through the pipe end to the coolant. The condensed liquid flows from both ends of the pipe through the wick structure back to the middle of the pipe to replace the liquid evaporated there.

In another embodiment, two or more heat pipes, each accommodating unidirectional heat flow, are placed around or between the cylinders with their low temperature ends in coolant passages.

In an alternative embodiment to casting the heat pipes in a cylinder block, a slot or groove may be cut across the deck of the block and the heat pipe(s) suitably bonded in the groove with a high thermal conductivity bonding agent.

Other objects and advantages of this invention will become more apparent from a detailed description of a preferred embodiment of the invention which follows. Reference will be had to the drawing figure which are described in the following section.

DESCRIPTION OF A PREFERRED EMBODIMENT

Figure 1:
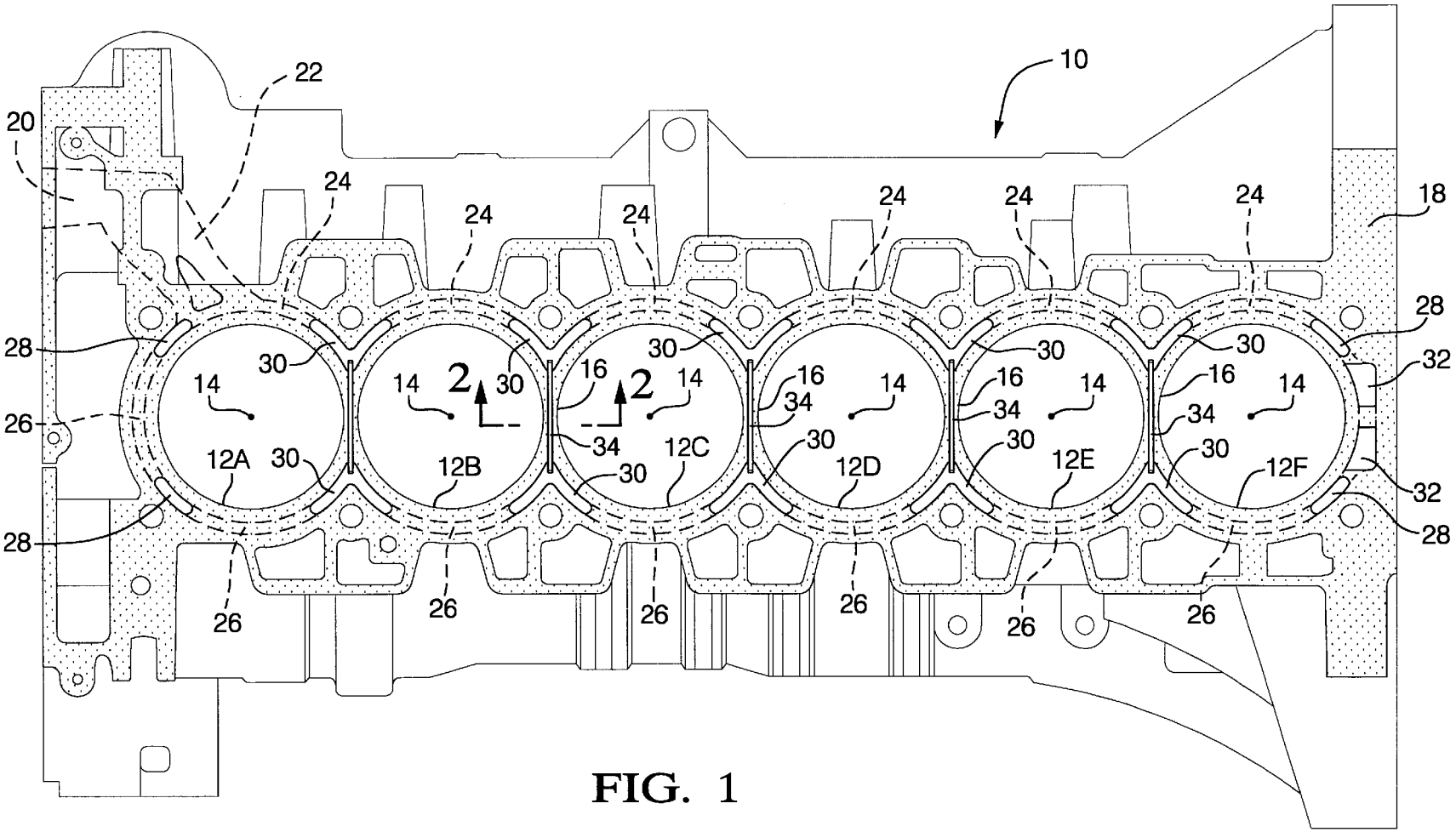
FIG. 1 is a top view of a representative siamese cast aluminum alloy cylinder block as may be used in the practice of this invention.

FIG. 1 shows a top view of a cylinder block casting 10 for an in-line, six cylinder, gasoline-fueled, internal combustion engine. The practice of the invention will be described in the example of this particular engine configuration, but the invention is not so limited. In cylinder block 10, the six cylinders 12A through 12F, respectively, are of identical shape and size, and the longitudinal axes (seen as points 14 in FIG. 1) of the cylinders are parallel, equi-spaced and co-planar. The cylinder block is a siamese-type block because there are no coolant passages formed in the five shared walls 16 between the six in-line cylinders 12A–12F.

The stippled portion of FIG. 1 shows the flat top deck portion 18 of cylinder block 10. As is well known in the assembly of an engine, a cylinder head and head gasket, neither shown, are bolted to cylinder block 10 against deck surface 18. The cylinder head provides the upper or ceiling portion of each combustion chamber associated with each cylinder. Air/fuel intake valves, exhaust valves and a spark plug for each cylinder are associated with the cylinder head. Of course, a piston with its connecting rod, not shown, will be assembled in each cylinder 12A–12F. The lower end of each connecting rod is connected to a crankshaft, not shown, which is partially contained in the lower portion of cylinder block 10. A crank case, not shown, bolted to the lower deck of block 10 encloses the rest of the crankshaft.

While much of the heat of combustion developed in each cylinder is converted to useful work in driving the pistons and crankshaft, unfortunately a considerable amount of heat is not available for such work and must be removed from each cylinder. In order to remove unused heat from the cylinder block 10, a conventional liquid coolant comprising water and ethylene glycol or propylene glycol with suitable stabilizing additives is employed. The coolant is pumped with a water pump, not shown, through coolant passages in the cylinder block 10. In the embodiment shown in FIG. 1, coolant enters at passage inlet 20 at one end of the line of cylinders, near cylinder 12A. The coolant flow splits at 22 and flows through passages 24 and 26 around portions only of the circumferential walls that define each cylinder. Since there are no coolant passages in common cylinder wall portions 16 of the line of six cylinders 12A–12F, the coolant flow is along the sides only of the line of cylinders.

Coolant passages 24 and 26 are mostly contained within cylinder block 10, and the flow of much of the coolant is from cylinder 12A toward cylinder 12F in the generally parallel coolant passages 24 and 26 as viewed in FIG. 1. However, a portion of the coolant flows out of block 10 into the cylinder head, not shown, through a series of cylinder block coolant outlets 28, 30 and 32. Coolant outlets 28 are formed in coolant passages 24 and 26 adjacent cylinders 12A and 12F, respectively, as viewed in FIG. 1. Coolant outlets 30 are formed in coolant passages 24 and 26 in the regions adjacent the common cylinder walls 16. Coolant outlets 32 are provided at the downstream coolant flow end of the block 10, downstream of cylinder 12F, to permit the return flow of the coolant through the cylinder head. Thus, coolant is pumped into the inlet 20 of cylinder block 10 and into parallel coolant passages 24 and 26 and around, but not between, cylinders 12A–12F. Successive portions of the coolant leave cylinder block 10 through the several coolant outlets 28, 30 and 32 to the above, adjacent regions of the cylinder head block and for return to the inlet side of the coolant pump.

In an effort to reduce the mass of automotive vehicles, automobile engine cylinder blocks are increasingly being cast from suitable aluminum alloys. Often aluminum alloys that are suitable for casting the complex shape of a cylinder block are not sufficiently resistant to wear from pistons rubbing on cylinder wall surfaces. Iron liners are inserted in the cylinder portions of such cast aluminum blocks. In order to accommodate the liners without lengthening the block, siamese cylinder block designs are employed with little or no coolant flow between adjacent cylinders. As is known, a substantial portion of the heat flux in each cylinder block occurs in the upper portion of each cylinder near the top deck 18 of the block. If excessive temperatures are experienced in the cylinder block and pistons, damage to the pistons in the top ring groove portion occurs. It is necessary to manage heat removal from the cylinder block to avoid damage to the pistons and/or block.

In accordance with this invention, improved heat removal from the cylinder block is accomplished without resort to forming thin, intricate cooling passages in the common cylinder wall portions 16 of the block. This is done by using suitable heat pipes 34 in or near the top deck region 18 of cylinder block 10 in the common cylinder walls 16.

Figure 2:
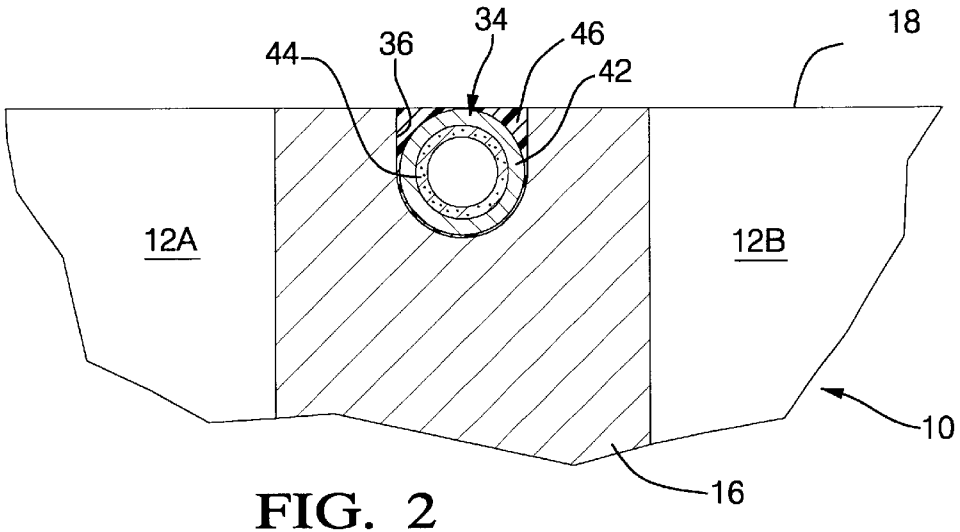
FIG. 2 is a cross-sectional view of an enlarged portion of the deck region at the common wall between two adjacent cylinders of the cylinder block of FIG. 1.
Figure 3:
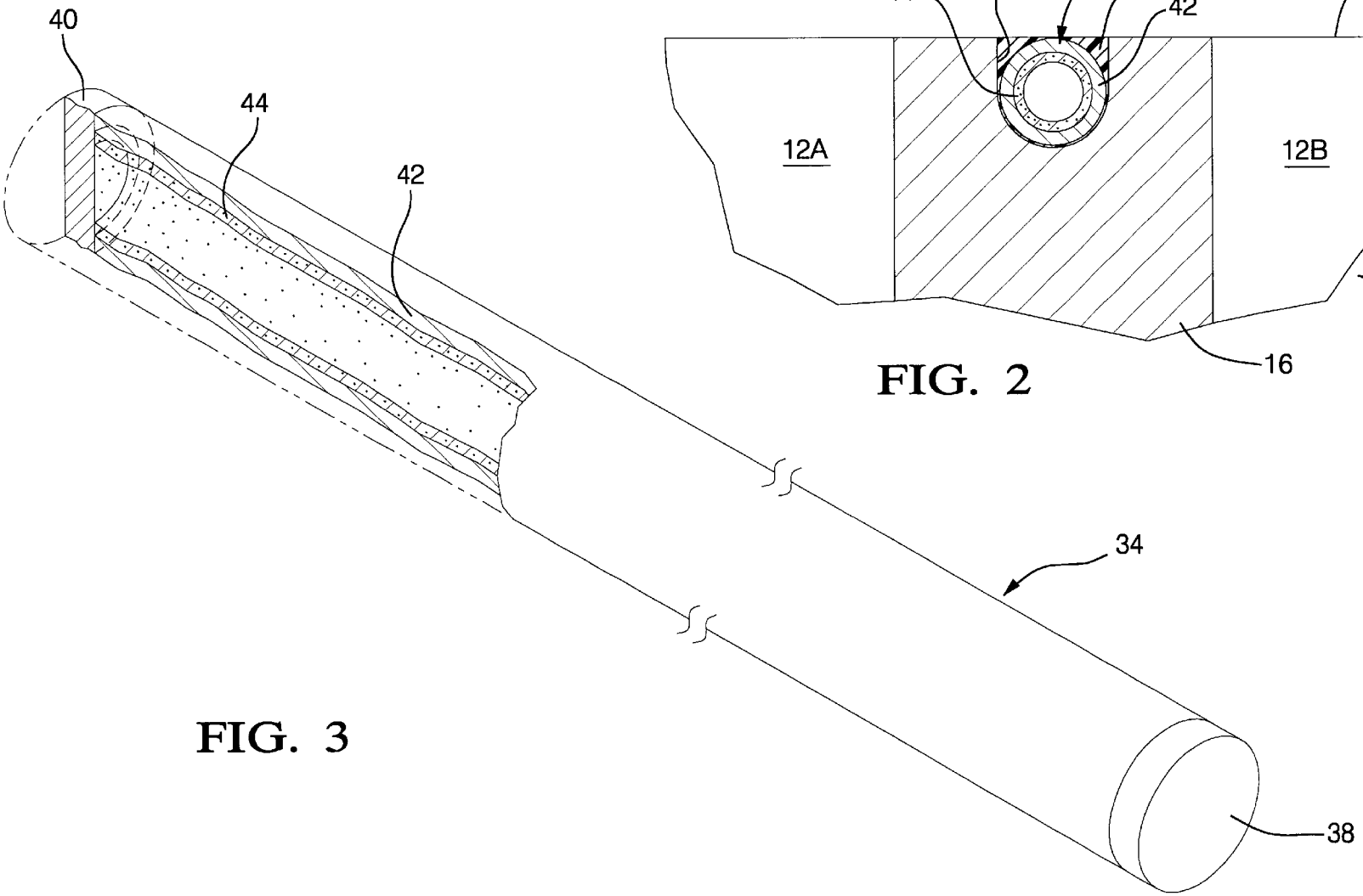
FIG. 3 is a sectional view of a heat pipe suitable for use in the practice of this invention.

As seen in FIGS. 1 and 2, five heat pipes 34 are located in straight shallow slots 36 cut into the top deck 18 of cylinder block 10 in the common walls 16 between the in-line cylinders 12A–12F. Each heat pipe 34 extends in walls 16 from coolant passage 24 on one side of the line of cylinders 12A–12F to coolant passage 26 on the other side of the cylinders. Referring to FIGS. 1 and 3, it is seen that the ends 38, 40 of each pipe 34 extend into the flowing coolant. In this embodiment of the invention, heat pipes 34 are being placed in slots 36 formed in an existing cylinder block. A suitable thermally conductive epoxy resin 46, or the like, is used to embed the heat pipe in good heat transfer contact with the aluminum cylinder block. In another embodiment, each heat pipe may be cast in place when the cylinder block is cast by suitably locating the pipes in the foam pattern or other casting mold.

Heat pipes are widely used in many applications including computer and aerospace applications. They are especially useful where it is necessary to remove appreciable heat flux in an application where space for heat transfer devices is limited. Heat pipes are simple but elegant devices comprising a tube or pipe of high thermal conductivity material, such as copper, with a thermally conductive wick structure (e.g., of sintered copper powder) on the internal wall of the pipe. The heat pipe is evacuated of air or other gas, and a suitable quantity of a high latent heat working liquid such as water is introduced into the pipe and the ends of the pipe are closed. FIG. 3 shows such a heat pipe 34 with pipe 42, wick structure 44 and closed ends 38 and 40. The water is not shown in FIG. 3. The amount required is small and is contained in the porous sintered copper powder wick structure so that freezing ambient temperatures have no effect on the heat pipe.

In the embodiment shown in the drawing figures, the heat flow involving heat pipe 34 is from the adjacent cylinders through common wall 16 into the center region of the pipe. During engine operation, heat flows by conduction into pipe 42 and wick structure 44. The heat causes liquid water (or other suitable working fluid) to evaporate and the evaporated vapor expands in the pipe and flows under its vapor pressure toward ends 38 and 40. Ends 38 and 40 are immersed in circulating coolant in coolant passages 24 and 26. Thus, heat pipe ends 38 and 40 are relatively cool, and the water vapor gives up its heat of vaporization to the coolant at the ends and is condensed. The condensed water enters the wick structure and flows by capillary action toward the center of the heat pipe as water is evaporated from the center region. The flow of the working fluid is cyclical and the heat flow in this heat pipe/cylinder block arrangement is, thus, bi-directional, i.e., from the middle of the pipe to both of its ends.

As is well known, as long as a heat pipe has a heat source and a heat sink, it will operate indefinitely without additional elements, mechanisms or controls. Heat pipes are available (e.g., from Thermacore Industries of Lancaster, Pa.) in a variety of diameters and lengths and designs. Copper pipes with sintered copper wick structures and using water as a working fluid are capable of continuous, high performance heat transfer. For example, power density capacities of 50 $W/cm^2$ are attained.

Thus, referring to the depicted embodiment, heat pipes 34 supplement the normal removal of heat from the hot region of cylinders 12A–12F through their common walls 16 into the coolant flowing in coolant passages 24 and 26. The use of such heat transfer devices simplifies the design of cylinder blocks for cooling by eliminating or reducing the need for coolant passages in the thin common cylinder wall portions of the block.

The embodiment described employed a single horizontal heat pipe in the top deck region of a cylinder block in the common wall portions between a line or bank of cylinders. Heat pipes will operate in virtually any attitude because the water can flow by capillary forces against the force of gravity. Thus, the number and arrangement of heat pipes serving to remove heat from an engine cylinder into a coolant is limited only by the imagination of the engine designer. Obviously, groups of smaller unidirectional heat pipes could be used in place of, or in addition to the bi-directional pipes depicted in the drawings.

As described, heat pipes are demonstrated to have particular utility in siamese engine cylinder blocks where space for coolant passages is limited. But heat pipes can be used to reduce the size of conventional cylinder blocks by reducing the heat transfer area between the cylinders and coolant passages.

While the invention has been described in terms of a preferred embodiment, it is apparent that other forms of the invention could readily be adapted by one skilled in the art. Accordingly, the scope of the invention is to be considered limited only by the following claims.

What is claimed is:

1. A cylinder block for an internal combustion engine, said cylinder block comprising a plurality of cylinders defined by cylinder walls and arranged in a straight line with adjoining cylinders sharing a common wall, a coolant jacket defined by a coolant jacket wall positioned parallel to and outboard of said cylinder walls to define a coolant passage for coolant flow through said block, and a heat pipe in a cylinder wall, said heat pipe having at least one of its ends positioned in said coolant passage, wherein said heat pipe comprises a copper pipe, a sintered copper wick and water.

2. A cylinder block for an internal combustion engine, said cylinder block comprising a plurality of cylinders defined by cylinder walls and arranged in a straight line with adjoining cylinders sharing a common wall, a coolant jacket defined by a coolant jacket wall positioned parallel to and outboard of said cylinder walls to define a coolant passage for coolant flow through said block, and a heat pipe in a cylinder wall, said heat pipe having at least one of its ends positioned in said coolant passage, said block comprising coolant passages outboard of each side of said line of cylinders and a heat pipe located in each common wall and positioned with an end positioned in each of said coolant passages, wherein said heat pipe comprises a copper pipe, a sintered copper wick and water.

3. A siamese cylinder block for an internal combustion engine, said cylinder block comprising a plurality of cylinders defined by cylinder walls and arranged in a straight line with adjoining cylinders sharing a common wall, a coolant jacket defined by coolant jacket walls positioned parallel to and outboard of each side of the line of said cylinder walls to define coolant passages for coolant flow through said block, and a heat pipe in a cylinder wall, said heat pipe having at least one of its ends positioned in said coolant passage, wherein said heat pipe comprises a copper pipe, a sintered copper wick and water.

4. A siamese cylinder block for an internal combustion engine, said cylinder block comprising a plurality of cylinders defined by cylinder walls and arranged in a straight line with adjoining cylinders sharing a common wall, a coolant jacket defined by coolant jacket walls positioned parallel to and outboard of each side of the line of said cylinder walls to define coolant passages for coolant flow through said block, and a heat pipe in a cylinder wall, said heat pipe having at least one of its ends positioned in said coolant passage, comprising a heat pipe in a common wall with an end of said pipe in each of said coolant passages, wherein said heat pipe comprises a copper pipe, a sintered copper wick and water.

5. A siamese cylinder block for an internal combustion engine, said cylinder block comprising a plurality of cylinders defined by cylinder walls and arranged in a straight line with adjoining cylinders sharing a common wall, a coolant jacket defined by coolant jacket walls positioned parallel to and outboard of each side of the line of said cylinder walls to define coolant passages for coolant flow through said block, and a heat pipe in a cylinder wall, said heat pipe having at least one of its ends positioned in said coolant passage, comprising a heat pipe in each common wall in said block, wherein said heat pipe comprises a copper pipe, a sintered copper wick and water.

6. A cylinder block comprising a plurality of cylinders defined by cylinder walls with adjoining cylinders defining a common wall, a first coolant passage extending generally parallel to the cylinders at a first end of the common wall and a second coolant passage extending generally parallel to the cylinders at a second end of the common wall and a pipe extending through the common wall from the first coolant passage to the second coolant passage and generally perpendicular to the cylinders.

* * * * *